United States Patent [19]

Honma

[11] Patent Number: 4,607,587

[45] Date of Patent: Aug. 26, 1986

[54] TAPE MARKING AND CUTTING APPARATUS

[75] Inventor: Yoshiaki Honma, Tokyo, Japan

[73] Assignee: Tokyo Juki Industrial Co., Ltd., Tokyo, Japan

[21] Appl. No.: 678,453

[22] Filed: Nov. 5, 1984

[51] Int. Cl.[4] ..... B05C 11/00

[52] U.S. Cl. ..... 118/37; 118/40; 118/698

[58] Field of Search ..... 118/35, 37, 40, 698

[56] References Cited

U.S. PATENT DOCUMENTS 3,875,895 4/1975 Todd et al. ..... 118/40

3,991,706 11/1976 Pearl ..... 118/696

*Primary Examiner*—Michael R. Lusignan

*Attorney, Agent, or Firm*—Yount & Tarolli

[57] ABSTRACT

A tape marking and cutting device which can be operated to apply marking on tape and to cut the marked tape to a desired length. The sequence is controlled by a microprocessor which devices a pulse motor which in turn drives a tape feed roller. The feed roller drives the tape in correspondence with the desired marking interval and a marking device is actuated. After each marking, the feed roller feeds the tape corresponding to the remaining length and the tape is cut. The sequence can be preset in a program.

4 Claims, 8 Drawing Figures

TAPE MARKING AND CUTTING APPARATUS

BACKGROUND OF THE INVENTION

The present invention relates to a tape marking and cutting apparatus which feeds tape intermittently in one direction, cuts the tape to a desired length, and also applies marking at desired intervals onto the tape.

Conventionally, tape has been cut to desired lengths by a cutting machine, and a marking machine applies desired marking on the cut strips one by one. Thus, working efficiency has been very low.

SUMMARY OF THE INVENTION

The object of the present invention is to provide a tape marking and cutting apparatus which eliminates the above-mentioned disadvantage, and which performs the marking and cutting in a continuous series of operations. Such tape is used in sewing shops as lining to materials for suits, the markings defining certain desired positions, e.g., the position of a pocket and the width of the finished suit.

The tape marking and cutting apparatus, according to the present invention, comprises a feed roller for intermittently feeding the tape, a cutting device for cutting the tape, a marker for applying marking on the tape and adapted to normally separate from the tape, a marking device for urging the marker in one direction onto the upper surface of the tape, an input means for setting information as to at least one mark position and at least one cutting length, a memory means for storing each item of information set by said input means; and a control means for sequentially reading said stored information in the memory means, driving said feed roller based on said mark position information, driving said marking device when said feed roller is stopped, and actuating said cutting device based on said tape cutting length information after said feed roller has been driven and stopped on the basis of the last mark position information.

Thus, the tape marking and cutting apparatus according to the present invention can apply a desired number of marks on one tape section and the tape may be cut in desired lengths. Such setting of marking interval and cutting length can be stored in the memory, and can be read by the control device. Consequently, working efficiency is greatly improved.

The present invention will be described in detail with reference to a preferred embodiment, by way of example, and accompanying drawings.

DETAILED DESCRIPTION OF THE PREFERRED EMBODIMENT

Figure 1:
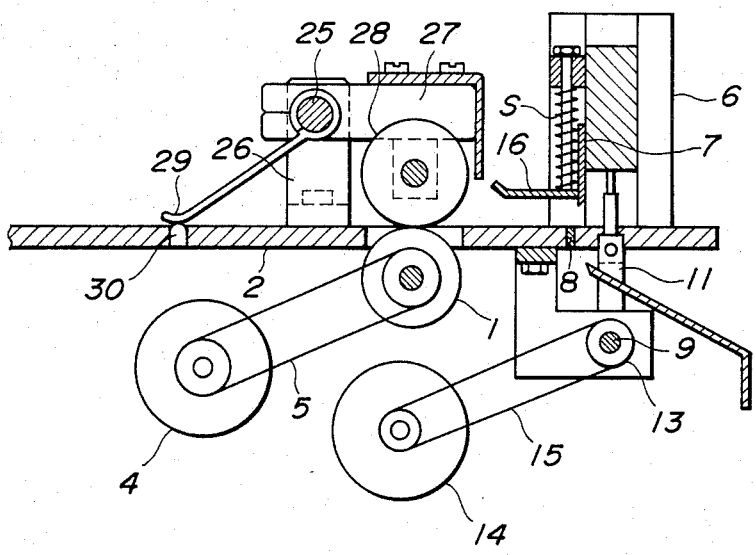
FIG. 1 is a schematic sectional view of a tape marking and cutting apparatus, according to the present invention.
Figure 2:
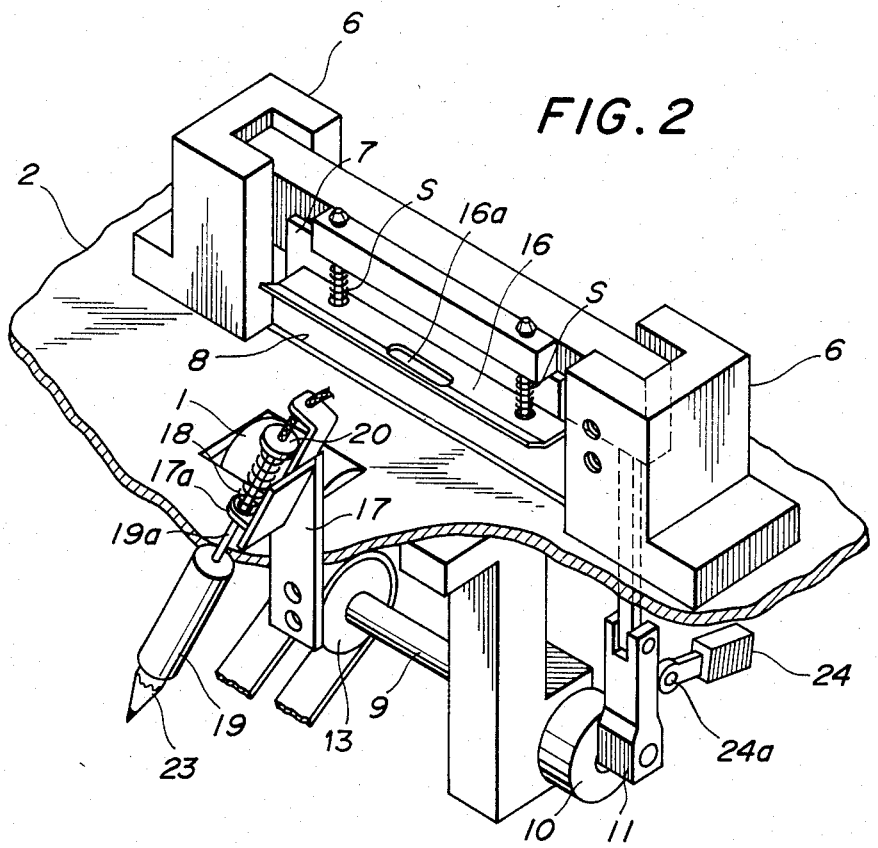
FIG. 2 is a perspective view, a portion being broken away and a portion being disassembled, of the apparatus shown in FIG. 1.
Figure 3:
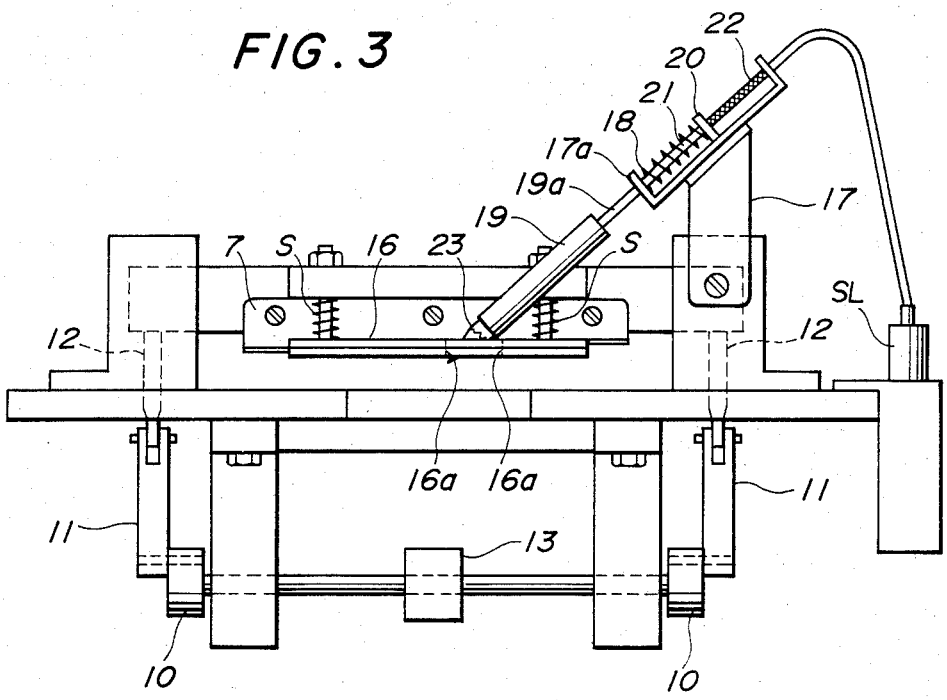
FIG. 3 is a front view of a portion of the apparatus shown in FIG. 1.

Referring to FIGS. 1–3, a tape marking and cutting apparatus according to the present invention comprises a feed roller 1 which is rotatably supported by a frame, a portion of the roller 1 being exposed within a gap in the upper surface of an upper plate 2. A pulse motor 4 is mounted on the frame, and a timing belt 5 rotatably connects the feed roller 1 with the pulse motor 4.

Generally U-shaped support bodies 6 and 6 are secured to the upper plate 2 in opposed relation to each other. The movable blade 7 shown in FIG. 2 is vertically slidably engaged with the support bodies 6 and 6. A fixed blade 8 engageable with the movable blade 7 is secured on the edge of the upper plate 2 so as to cut the tape in cooperation with the movable blade 7. The fixed and movable blades 8 and 7 form a cutting device.

As shown in FIG. 2, a shaft 9 is rotatably supported by the frame and annular crank bodies 10 and 10 are secured to both ends of the shaft 9. A reciprocable rod 11 is supported by a crank pin of each crank body 11 and the free end of the crank body 11 is pivotably connected to a connecting rod 12 which is mounted on the lower end of the movable blade 7.

As shown in FIG. 1, a sprocket 13 is secured to the shaft 9 and a drive motor 14 is mounted on the frame. The motor 14 drives the sprocket 13 through a belt 15.

An urging plate 16 is vertically movably supported by the movable blade 7 and is urged by a spring s downwards.

A bracket 17 is secured with one support body 6 and has a support **17*a* which has a through hole 18**.

A marker holder 19 is secured with a bar **19*a* which is slidably engaged in the through hole 18. A spring 21 is engaged between the upper surface of the support 17*a* and the lower surface of a plate 20 which is secured to the bar 19*a*, and the spring 21 normally urges the marker holder 19** towards an upper inoperative position.

A wire 22 is secured with the plate 20 and extends to an electromagnetic solenoid SL which is mounted on the frame. A marker 23, such as red pencil, is inserted in the marker holder 19 and is adapted to move downwards into a slot **16*a* which is formed in the urging plate 16** in an operative position.

A limit switch 24 shown in FIG. 2 has a contact element **24*a* which operates to stop the motor 14 when the movable blade 7 is in its uppermost position. The contact element 24*a* detects lateral movement of the reciprocable rod 11**.

Figure 4:
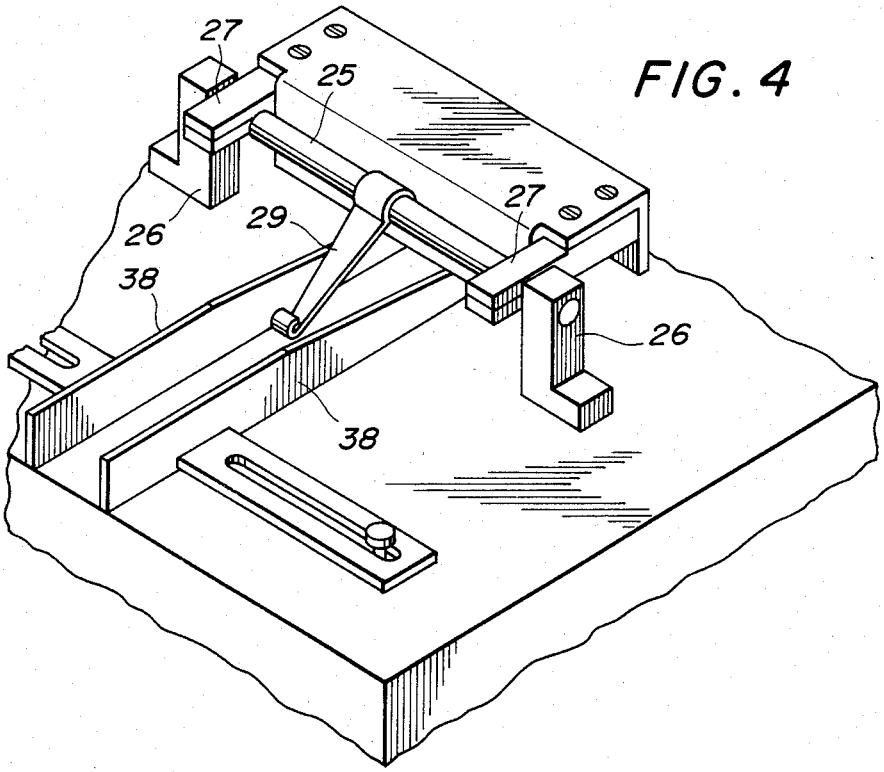
FIG. 4 is a perspective view of a portion of the apparatus shown in FIG. 1.

As shown in FIGS. 1 and 4, a shaft 25 is rotatably supported by bearing blocks 26 and 26 which are secured on the upper plate 2. Support arms 27 and 27 are secured with the shaft 25, and each rotatably supports an urging roller 28 which contacts the feed roller 1.

A movable contact 29 is pivotably supported by the rotatable shaft 25 and the free end of the contact 29 contacts a fixed contact 30. When a tape is between the contacts 29 and 30, the movable contact 29 is electrically separated from the fixed contact 30. When the contacts 29 and 30 directly contact each other, i.e. when there is no tape on the plate 2, a buzzer rings and operation of the feed roller is stopped.

Figure 5:
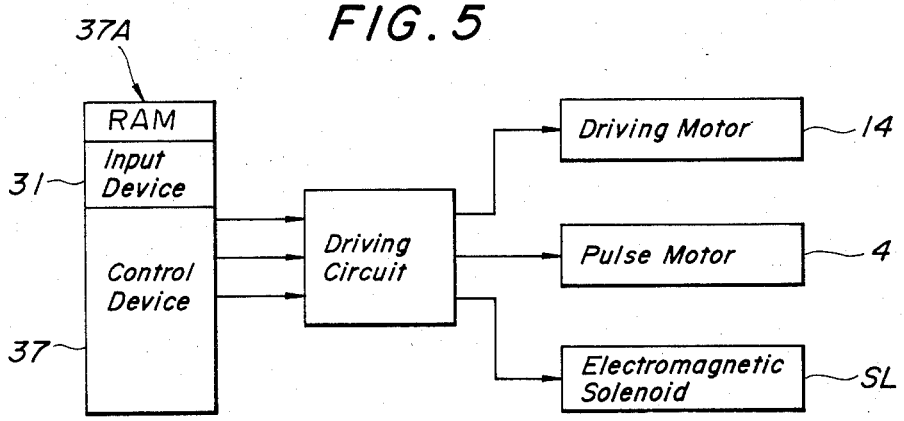
FIG. 5 is a block diagram of a control apparatus for controlling the apparatus shown in FIG. 1.
Figure 7:
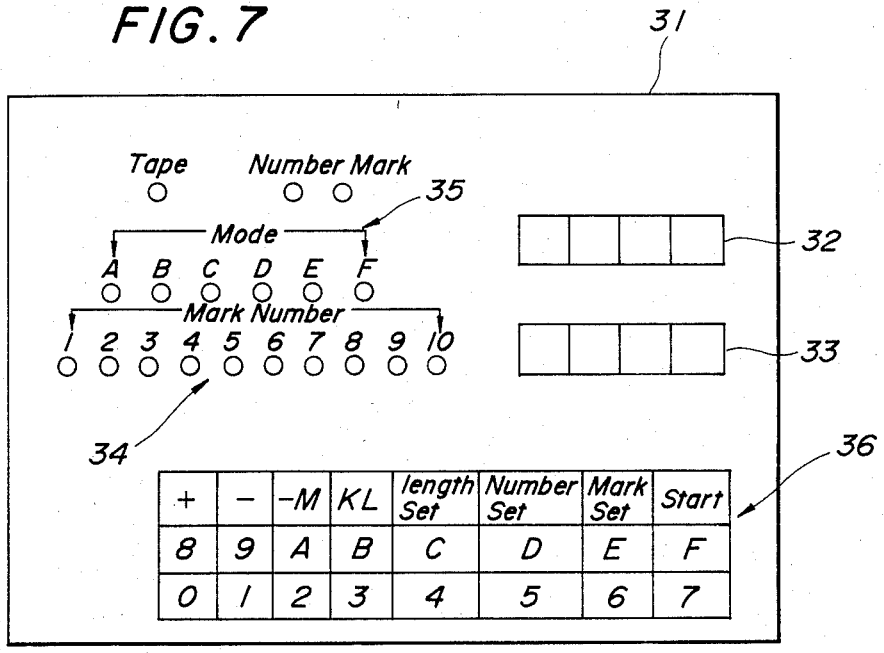
FIG. 7 is a front view of an input device for use with the control apparatus shown in FIG. 5.

As shown in FIGS. 5 and 7, an input device 31 mounted on the outside surface of the frame provides a first LED display portion 32 which shows tape cutting length, a second LED display portion 33 which shows tape cutting number and marking interval, ten first indication lamps 34 which show input order of the marking interval, six mode assuring lamps 35 which assure mode input which consists of cutting length, cutting number and marking interval, and input keys section 36.

A control device 37 stores cutting length data, cutting number data and marking interval data. A memory device RAM is provided. From these data, the control device 37 controls the pulse motor 4, drive motor 14 and the electromagnetic solenoid SL based on a program stored in ROM. The input device 31, memory device RAM and the control device 37 forms a microcomputer 37A.

Figure 8:
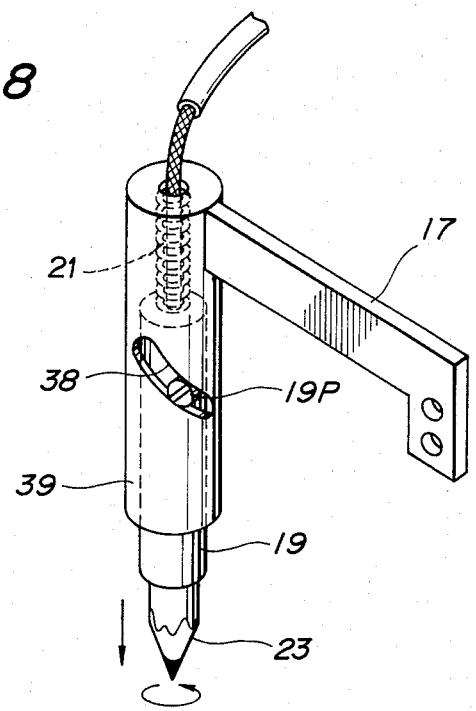
FIG. 8 is a perspective view of a second embodiment of the marker shown in FIGS. 2 and 3.

FIG. 8 shows a variation of the marker holder 19. The support 17A shown in FIG. 3 is in this case a hollow cylindrical body 39 which is secured to the bracket 17. The cylindrical body 39 forms a slant slot 38. The marker holder 19 with the pencil 23 is slidably supported in the cylindrical body 39. A pin 19P is secured to the marker holder 19 through the slot 38. The spring 21 pulls the marker holder 19 upwards, so that the pin 19P normally contacts the upper end of the slot 38. The spring 21 is, in this case, in the cylindrical body 39. When the Boden wire 22 pushes the marker holder 19 downwards, the marker holder 19 and the marker 23 move downward and turn along the slot 38.

Operation of the apparatus according to the present invention will now be described.

When the electric power source is ON, the first lamp of the first indication lamp 34 and the A mode lamp of the mode assuring lamp 35 are lit. When the movable blade 7 is at its lower position, the limit switch 24 actuates the drive motor 14 to move the movable blade upwards. At the uppermost position of the movable blade 7, the limit switch 24 stops the drive motor 14.

Next, cutting length, cutting number and marking interval are supplied by the key switch 36 and are stored in the memory RAM of the microcomputer 37A. Marking intervals can be supplied to the extent of the number of first indication lamps 34, i.e. ten in this case.

When the A mode input is completed, the B mode lamp lights up, which shows that the next mode input can be done. Thus, six different modes, i.e. different sets of cutting length, cutting number and marking interval can be stored, corresponding to modes A–F.

After the input operation of the information is completed, tape guide plates 38 and 38 are moved, as necessary, to the desired width of the tape. The forward end of a tape which is wound in a reel is pulled and is passed from left to right in FIG. 1, to pass between the rollers 1 and 28 and between the movable and fixed blades 7 and 8.

The desired mode selection switch 35, i.e. one of the modes A–F, and the start button of the switches 36 are depressed. At first the movable blade 7 moves downwards to cut the end portion of the tape. Next, based on marking position information, the pulse motor 4 actuates a predetermined number of pulses to drive the feed roller a corresponding distance which is equivalent to the marking interval length which had been set in the first mode A. Then, the electromagnetic solenoid SL energizes to push the wire 22 such as to move the marker holder 19 downwards against the spring 21. The marker 23 is urged onto the tape. Further, the marker 23 slides on the tape along the slot 16*a*. After the marking the electromagnetic solenoid SL de-energizes and the marker 23 returns to its upper position.

This operation is repeated in accordance with the number of marking intervals inputted and after that the sum of the mark position data is substracted from the tape cutting length information and the feed roller 1 turns to an extent corresponding to the difference thereby feeding a required amount of the tape. The feed roller 1 stops and the movable blade 7 reciprocates one cycle to cut the tape. When the movable blade 7 lowers, the tape is urged downwards by the urging plate 16 on which the force of the spring s acts to so urge the tape.

After the tape cutting, the operation is repeated until the predetermined tape cutting number preset in the corresponding mode is reached.

Figure 6:
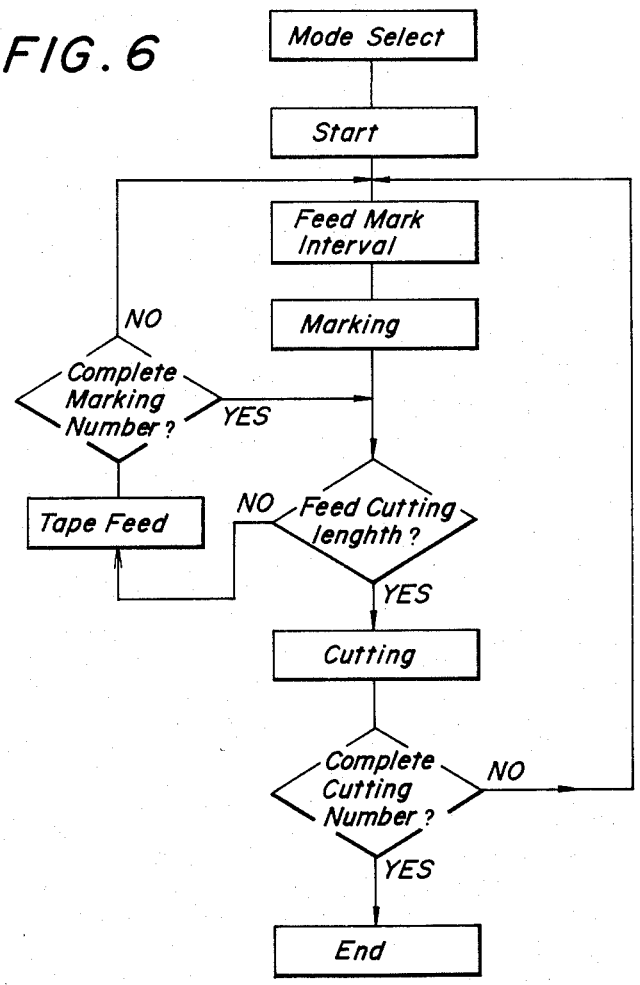
FIG. 6 is a flow chart for the control apparatus shown in FIG. 5.

The above-mentioned operation is written in the microcomputer 37A as a flow chart as shown in FIG. 6. It will be unnecessary to repeat the explanation.

It will be appreciated that the tape marking and cutting apparatus according to the present invention continuously and automatically performs marking at a desired interval and cutting of a desired length of a tape to the extent of a preset number. Further, changes in the number of tapes to be cut, cutting length and marking interval can be easily performed.

What is claimed is:

1. A tape marking and cutting apparatus comprising feed means for feeding tape, cutter means for cutting the tape, and marker means for marking on an upper side surface of the tape with a marker element, said marker means including marker actuator means for moving the marker element into abutting engagement with the upper side surface of the tape and for moving the marker element on the upper side surface of tape while maintaining the marker element in abutting engagement with the upper side surface of the tape to thereby form a mark on the upper side surface of the tape.

2. A tape marking and cutting apparatus as set forth in claim 1 wherein said marker actuator means includes means for sliding the marker element on the upper side surface of the tape.

3. A tape marking and cutting apparatus as set forth in claim 1 wherein said marker actuator means includes means for rotating the marker element on the upper side surface of the tape.

4. The apparatus as set forth in claim 1 further including control means for initiating operation of said feed means to feed a first predetermined length of tape past said marker means, for interrupting operation of said feed means when the first predetermined length of tape has been fed past said marker means, for effecting operation of said marker means to apply a mark to the upper side surface of the tape upon interruption of the operation of said feed means, for resuming operation of said feed means to feed tape past said cutter means after said marker means has applied a mark to the upper side surface of the tape, for interrupting operation of said feed means when a second predetermined length of tape has been fed past said cutter means, and for effecting operation of said cutter means to cut the tape after the second predetermined length of tape has been fed past said cutter means.

* * * * *

UNITED STATES PATENT AND TRADEMARK OFFICE

CERTIFICATE OF CORRECTION

PATENT NO. : 4,607,587

DATED : August 26, 1986

INVENTOR(S) : Yoshiaki Honma

It is certified that error appears in the above-identified patent and that said Letters Patent is hereby corrected as shown below:

On the title page
[22] change "Nov. 5, 1984" to -Dec. 5, 1984-

Signed and Sealed this

Third Day of March, 1987

*Attest:*

DONALD J. QUIGG

*Attesting Officer*

*Commissioner of Patents and Trademarks*